US009041753B2

(12) United States Patent
Yahata et al.

(10) Patent No.: US 9,041,753 B2
(45) Date of Patent: May 26, 2015

(54) SHEET DISCHARGING DEVICE AND ERASING DEVICE

(71) Applicants: KABUSHIKI KAISHA TOSHIBA, Tokyo (JP); TOSHIBA TEC KABUSHIKI KAISHA, Tokyo (JP)

(72) Inventors: Isao Yahata, Shizuoka-ken (JP); Kikuo Mizutani, Shizuoka-ken (JP); Takahiro Kawaguchi, Shizuoka-ken (JP); Yoshiaki Sugizaki, Shizuoka-ken (JP); Ken Iguchi, Shizuoka-ken (JP); Hiroyuki Taki, Shizuoka-ken (JP); Hiroyuki Tsuchihashi, Shizuoka-ken (JP); Chiaki Iizuka, Shizuoka-ken (JP); Hidetoshi Yokochi, Shizuoka-ken (JP); Toshiaki Oshiro, Shizuoka-ken (JP); Hiroyuki Hazu, Shizuoka-ken (JP); Yoichi Yamaguchi, Shizuoka-ken (JP); Hiroyuki Sugiyama, Shizuoka-ken (JP); Yuichi Saito, Shizuoka-ken (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/223,694

(22) Filed: Mar. 24, 2014

(65) Prior Publication Data

US 2014/0203492 A1 Jul. 24, 2014

Related U.S. Application Data

(62) Division of application No. 13/485,547, filed on May 31, 2012, now Pat. No. 8,717,396.

(60) Provisional application No. 61/492,807, filed on Jun. 2, 2011, provisional application No. 61/502,321, filed on Jun. 28, 2011.

(51) Int. Cl.
*B41J 29/16* (2006.01)
*B65H 7/02* (2006.01)
(Continued)

(52) U.S. Cl.
CPC ... *B65H 7/02* (2013.01); *B41J 2/32* (2013.01); *B41J 2202/37* (2013.01); *B65H 31/24* (2013.01);
(Continued)

(58) Field of Classification Search
USPC ..... 347/171, 179
See application file for complete search history.

(56) References Cited

U.S. PATENT DOCUMENTS 6,095,518 A 8/2000 Allmendinger et al.
7,942,414 B2 5/2011 Taki et al.
(Continued)

FOREIGN PATENT DOCUMENTS

JP 07-181847 7/1995
JP 2009-126628 6/2009

*Primary Examiner* — Kristal Feggins
(74) *Attorney, Agent, or Firm* — Patterson & Sheridan LLP

(57) ABSTRACT

A sheet discharging device includes a first conveying path that guides a sheet to be conveyed. A second conveying path branches from the first conveying path. A sorting section sorts a sheet being conveyed on the first conveying path into either a downstream side of the branch point or the second conveying path. A first discharge tray is placed at a position downstream of the first conveying path and receives a sheet discharged from the first conveying path at a first sheet loading surface. A second discharge tray is placed at a position downstream of the second conveying path and below the first discharge tray, and receives a sheet discharged from the second conveying path at a second sheet loading surface whose distance to the first sheet loading surface increases toward a downstream side thereof in a sheet discharging direction.

15 Claims, 9 Drawing Sheets

(51) Int. Cl.

| | |
|---|---|
| ***B41J 2/32*** | (2006.01) |
| ***B65H 31/24*** | (2006.01) |
| ***B65H 31/26*** | (2006.01) |
| ***B65H 31/34*** | (2006.01) |
| ***G03G 21/00*** | (2006.01) |

(52) U.S. Cl.

CPC ..... *B65H 31/26* (2013.01); *B65H 31/34* (2013.01); *B65H 2301/511* (2013.01); *B65H 2404/1521* (2013.01); *B65H 2404/63* (2013.01); *B65H 2405/114* (2013.01); *B65H 2405/115* (2013.01); *B65H 2405/332* (2013.01); *B65H 2405/354* (2013.01); *B65H 2601/321* (2013.01); *B65H 2601/325* (2013.01); *B65H 2801/06* (2013.01); *G03G 21/00* (2013.01)

(56) References Cited

U.S. PATENT DOCUMENTS

| | | | | |
|---|---|---|---|---|
| 8,456,497 | B2 * | 6/2013 | Iguchi et al. | 347/179 |
| 2010/0118361 | A1 | 5/2010 | Iguchi | |
| 2010/0315475 | A1 * | 12/2010 | Taki et al. | 347/179 |
| 2010/0321457 | A1 | 12/2010 | Kawaguchi et al. | |
| 2011/0211033 | A1 | 9/2011 | Yahata et al. | |
| 2011/0221852 | A1 * | 9/2011 | Yahata et al. | 347/179 |
| 2012/0038732 | A1 * | 2/2012 | Iguchi et al. | 347/179 |

* cited by examiner

SHEET DISCHARGING DEVICE AND ERASING DEVICE

CROSS-REFERENCE TO RELATED APPLICATION

This application is a divisional of U.S. patent application Ser. No. 13/485,547, filed on May 31, 2012, which is based upon and claims the benefit of priority from U.S. provisional application 61/492,807, filed on Jun. 2, 2011; and U.S. provisional application 61/502,321, filed on Jun. 28, 2011; the entire contents all of which are incorporated herein by reference.

FIELD

Embodiments described herein relate generally to a technique for improving the convenience for a user when taking out sheets outputted to a plurality of discharge trays.

BACKGROUND

Conventionally, there has been a sheet sorting device which includes a plurality of discharge trays provided along a vertical direction thereof and which sorts and discharges sheets into the plurality of discharge trays, respectively.

If it is attempted to reduce a size of the conventional sheet sorting device, however, a space between two discharge trays provided adjacent to each other in a vertical direction tends to be narrow. As a result, when a user takes out a sheet placed in the lower side discharge tray, there is a problem that the user has a difficulty in taking out the sheet in the lower side discharge tray due to the upper side discharge tray being an obstacle.

The present specification has been made in order to solve the above-described problem, and an object thereof is to provide a technique for improving the convenience for a user when taking out sheets discharged to a plurality of discharge trays.

DETAILED DESCRIPTION

According to an embodiment, a sheet discharging device includes: a first conveying path configured to guide a sheet to be conveyed; a second conveying path branched from the first conveying path at a branch point of the first conveying path; a sorting section configured to sort a sheet being conveyed on the first conveying path into either a downstream side of the branch point on the first conveying path or the second conveying path; a first discharge tray placed at a position downstream of the first conveying path in a sheet conveying direction thereof and configured to receive a sheet discharged from the first conveying path at a first sheet loading surface; and a second discharge tray placed at a position downstream of the second conveying path in a sheet conveying direction thereof and below the first discharge tray and configured to receive a sheet discharged from the second conveying path at a second sheet loading surface whose distance to the first sheet loading surface increases toward a downstream side thereof in a sheet discharging direction.

Embodiments will now be described below with reference to the drawings.

First Embodiment

Figure 1:
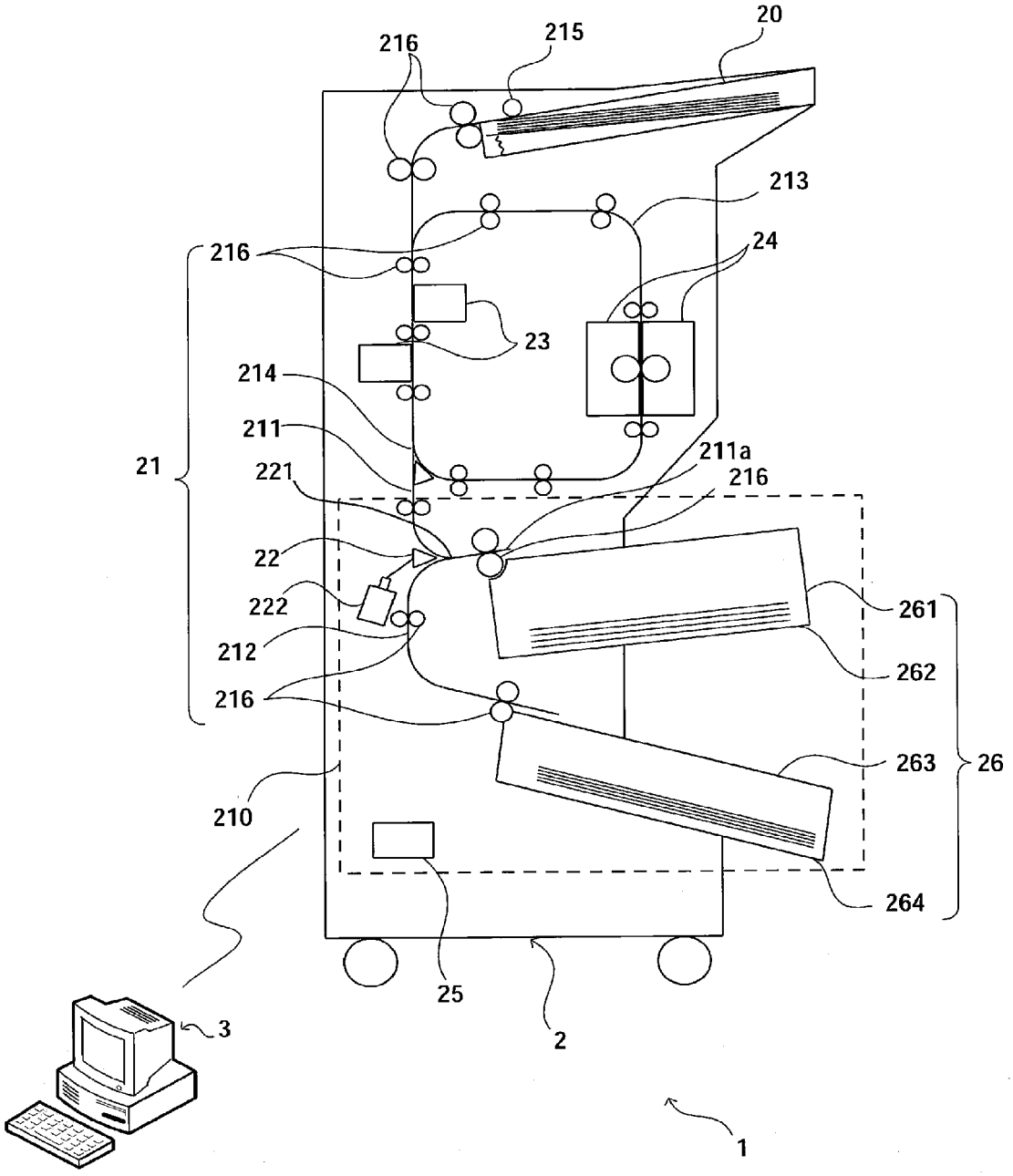
FIG. 1 is a schematic configuration diagram showing an erasing system according to a first embodiment.

FIG. 1 is a diagram showing an erasing system 1.

The erasing system 1 includes an erasing device 2 configured to perform an erasing process on a sheet on which an image has been formed, and a management device 3 connected to the erasing device 2 so as to be able to communicate therewith via a LAN (Local Area Network), a USB (Universal Serial Bus), or the like, and configured to determine whether or not an erasing process is performed on a sheet and send the determination result to the erasing device 2.

First, the erasing device 2 will be described in detail. The erasing device 2 performs an erasing process (an decolorizing process) on a sheet on which an image has been formed with a color erasable material (a decolorable colorant) so as to turn the color erasable material (the decolorable colorant) in a colored state into an erased state (a decolorized state), thereby erasing (decolorizing) the image on the sheet. In the present embodiment, it is assumed that an image on a sheet to be erased (decolorized) by the erasing device 2 is formed by a powdered color erasable toner (a powdered decolorable toner) or a liquid color erasable ink (a liquid decolorable ink) which is erased (decolorized) when heated. Moreover, in the present embodiment, a sheet is heated as the erasing process (decolorizing process) and a color of an image on the sheet is thereby erased (decolorized). The erasing device 2 includes a paper feeding cassette 20, a conveying section 21, a flapper 22 (sorting section), a reading section 23, a color erasing section (decolorizing section) 24, a controller 25 (a sorting determination section, a determination result receiving section), and discharge trays 26.

The paper feeding cassette 20 accommodates sheets on which images have been formed with a color erasable material. A sheet size thereof may vary, e.g., A4, A3, B5, or LTR.

The conveying section 21 conveys a sheet. The conveying section 21 includes a first conveying path 211, a loop-shaped conveying path 213, and a second branched conveying path 212 (hereinafter, the first conveying path 211, the loop-shaped conveying path 213, and the second branched conveying path 212 are collectively referred to as a conveying path). The first conveying path 211 is a conveying path for guiding a sheet of paper from the paper feeding cassette 20 to a tray 261 for reusable sheets of paper (first discharge tray) to be described later. The loop-shaped conveying path 213 is a conveying path branched from the first conveying path 211 at a first branch point 214 placed downstream of the reading section 23 to be described later positioned on the first conveying path 211 and joined to the first conveying path 211 at a position upstream of the reading section 23. The second conveying path 212 is a conveying path branched from the first conveying path 211 at a second branch point 221 (branch point) placed downstream of the first branch point 214 and configured to guide a sheet of paper to a tray 263 for non-reusable sheets of paper (second discharge tray) to be described later. The conveying section 21 also includes a pickup roller 215 for picking up a sheet stacked in the paper feeding cassette 20, and conveying rollers 216 for conveying the sheet. The conveying rollers 216 are provided at a plurality of positions along the first conveying path 211, the second conveying path 212, and the loop-shaped conveying path 213, and the rotating motions of the conveying rollers 216 on the conveying paths are controlled so as to convey a sheet on the first conveying path 211 to the tray 261 for reusable sheets of paper or the tray 263 for non-reusable sheets of paper.

The loop-shaped conveying path 213 is provided with the color erasing section 24 to be described later.

The flapper 22 is provided at the second branch point 221 at which the conveying path is branched from the first conveying path 211 to the second conveying path 212. The flapper 22 is operated by an actuator 222 between a first position for discharging a sheet to the tray 261 for reusable sheets of paper and a second position for guiding a sheet on the first conveying path 211 to the second conveying path 212 when a posterior end of the sheet is passed through the second branch point 221 and the conveying rollers 216 are then rotated inversely. In other words, if the controller 25 operates the actuator 222 so as to drive the flapper 22 to be at the first position for discharging a sheet to the tray 261 for reusable sheets of paper, the sheet on the conveying path is guided by the flapper 22 to the tray 261 for reusable sheets of paper provided at a downstream end 211*a* of the first conveying path 211. Alternatively, after the controller 25 operates the conveying rollers 216 so as to convey a sheet on the first conveying path 211 to the second branch point downstream side 211*a* of the first conveying path 211 (downstream side of the second branch point 221), the controller 25 operates the actuator 222 so as to set the flapper 22 at the position to guide the sheet to the second conveying path 212. Then, the rotations of the conveying rollers 216 are reversed, thereby guiding the sheet positioned on the second branch point downstream side 211*a* of the first conveying path 211 to the second conveying path 212 by the flapper 22.

The reading section 23 is provided on the loop-shaped conveying path 213, and is composed of CISs (Contact Image Sensors), CCDs (Charge Coupled Devices), sensors (image sensors), CMOS (Complementary Metal Oxide Semiconductor) image sensors, or the like. The reading section 23 includes a reading unit for reading an image on a first side of a sheet and a reading unit for reading an image on a second side which is the back side of the first side of the sheet. The reading section 23 allows the images on the both sides of the sheet to be read at once. The controller 25 stores image data obtained by the reading section 23 in a memory section such as a memory 253 or an HDD (Hard Disk Drive) 254 to be described later. In the present embodiment, image data obtained before an erasing process is performed is stored in the memory 253 or the HDD 254, thereby making it possible to reproduce the recorded image on a sheet even after the erasing process is performed. Thus, the convenience can be improved.

The color erasing section 24 is provided on a side facing the reading section 23. In the loop-shaped conveying path 213, a distance between the reading section 23 and the color erasing section 24 in a sheet conveying direction and a distance between the color erasing section 24 and the reading section 23 in the sheet conveying direction are respectively longer than a length (297 mm) of a long side of an A4-size sheet (210 mm×297 mm). The color erasing section 24 includes two color erasing units provided along the loop-shaped conveying path 213. In the color erasing section 24, the color erasing units abut against both sides of a sheet and heat them so as to erase images on the both sides of the sheet simultaneously.

The controller 25 sends output signals to the conveying section 21, the actuator 222, the conveying rollers 216, the reading section 23, and the color erasing section 24, sends the image data of a sheet read at the reading section 23 to the management device 3 from the erasing device 2, and receives an erasing capability determination result and a reusability determination result which are determined by the management device 3.

The discharge trays 26 are composed of the tray 261 for reusable sheets of paper and the tray 263 for non-reusable sheets of paper.

The tray 261 for reusable sheets of paper (first discharge tray) is placed at a position downstream of the first conveying path 211 in the sheet conveying direction, and receives a sheet discharged from the first conveying path 211 at a first sheet loading surface 262. As to a sheet being conveyed along the conveying path, if the controller 25 receives a determination result by the management device 3 showing that the sheet is reusable, the controller 25 operates, via the actuator 222, the flapper 22, the conveying rollers 216, and the like so as to discharge the sheet on the conveying path to the tray 261 for reusable sheets of paper.

The tray 263 for non-reusable sheets of paper (second discharge tray) is placed at a position downstream of the second conveying path 212 in the sheet conveying direction and below the tray 261 for reusable sheets of paper. The tray 263 for non-reusable sheets of paper receives a sheet discharged from the second conveying path 212 at a second sheet loading surface 264 configured so that a distance between the first sheet loading surface 262 and the second sheet loading surface 264 increases toward the downstream side thereof in a sheet discharging direction. As to a sheet being conveyed along the conveying path, if the controller 25 receives a determination result by the management device 3 showing that the sheet is not reusable, the controller 25 operates, via the actuator 222, the flapper 22, the conveying rollers 216, and the like so as to discharge the sheet on the conveying path to the tray 263 for non-reusable sheets of paper. Due to the thus formed large space between the first sheet loading surface 262 of the tray 261 for reusable sheets of paper and the second sheet loading surface 264 of the tray 263 for non-reusable sheets of paper on the downstream side in the sheet conveying direction, a user can take out sheets loaded on the second sheet loading surface 264 of the tray 263 for non-reusable sheets of paper more easily as compared with the conventional technique with which the tray 261 for reusable sheets of paper and the tray 263 for non-reusable sheets of paper are placed generally parallel to each other. In other words, the erasing device 2 of the present embodiment can solve the problem as in the conventional technique that a user has a difficulty in taking out sheets in the tray 263 for non-reusable sheets of paper due to the tray 261 for reusable sheets of paper being an obstacle. A distance between the tray 261 for reusable sheets of paper and the tray 263 for non-reusable sheets of paper is greater between ends of the trays (downstream ends in the discharging direction) positioned outside the erasing device 2 than between ends of the trays (upstream ends in the discharging direction) positioned within the erasing device 2. Thus, even when setting is made so as to have a positional relationship such that the fixed end of the tray 261 for reusable sheets of paper and the fixed end of the tray 263 for non-reusable sheets of paper inside the erasing device 2 are positioned close to each other, a user can easily take out sheets loaded in the tray 263 for non-reusable sheets of paper.

The downstream end of the second sheet loading surface 264 in the sheet discharging direction to the second sheet loading surface 264 may be configured so as to be projected more in a horizontal direction from the erasing device 2 than the downstream end of the first sheet loading surface 262 in the sheet discharging direction to the first sheet loading surface 262. Due to such a configuration, sheets loaded on the second sheet loading surface 264 are projected toward an outer side of a sheet discharging device 210 more than sheets loaded on the first sheet loading surface 262. As a result, there is obtained an advantageous effect such that the line of sight of a user to visually check the sheets loaded on the second sheet loading surface 264 is less likely to be blocked by the tray 261 for reusable sheets of paper.

Alternatively, the second sheet loading surface 264 may be formed so that the downstream end thereof in the sheet discharging direction is positioned lower than the upstream end thereof in the sheet discharging direction. Due to such a configuration, the lower side tray 263 for non-reusable sheets of paper to which sheets are discharged is often provided at a position spaced apart from a floor surface by a certain amount of distance since the erasing device 2 itself typically has casters or the like. Thus, by setting the tray 263 for non-reusable sheets of paper to be inclined downwardly as in the present embodiment, a space below the lower side tray 263 for non-reusable sheets of paper, otherwise being a dead space as in the conventional technique, can be utilized efficiently. Further, by setting the tray 263 for non-reusable sheets of paper, for which the visibility of discharged sheets is more likely to be poor since the tray is placed on the lower side, to be inclined downwardly, the visibility of sheets on the second sheet loading surface 264 in the tray 263 for non-reusable sheets of paper can be improved.

Alternatively, the first sheet loading surface 262 may be formed so that the downstream end thereof in the sheet discharging direction is positioned higher than the upstream end thereof in the sheet discharging direction. Due to such a configuration, a space above the upper side tray 261 for reusable sheets of paper is often a space with no obstacles. Thus, by setting the upper side tray 261 for reusable sheets of paper to be inclined upwardly, a dead space above the tray 261 for reusable sheets of paper can be utilized efficiently, and it is therefore possible to improve an operational performance for sheets discharged onto the tray 263 for non-reusable sheets of paper, e.g., an operational performance when taking out the sheets therefrom.

Further, it may be configured so that the downstream end of the first sheet loading surface 262 in the sheet discharging direction is positioned higher than the upstream end thereof in the sheet discharging direction, the downstream end of the second sheet loading surface 264 in the sheet discharging direction is positioned lower than the upstream end thereof in the sheet discharging direction, and an inclination angle of the second sheet loading surface 264 with respect to a horizontal plane is set to be greater than an inclination angle of the first sheet loading surface 262 with respect to a horizontal plane. Due to such a configuration, in view of the operational performance for a user, the maintenance thereof, and the like, the conveying rollers 216, scanners, photoreceptors, and the like are often provided more in a middle part or an upper part of the erasing device 2 than in a lower part thereof. Thus, in the case of the configuration such that the tray 261 for reusable sheets of paper is inclined upwardly and the tray 263 for non-reusable sheets of paper is inclined downwardly, since the various functional components described above are concentrated in the upper part of the device, a range over which the tray 261 for reusable sheets of paper can be inclined upwardly is often smaller than a range over which the tray 263 for non-reusable sheets of paper can be inclined downwardly. Thus, in order to ensure a sufficient space, in view of the operational performance thereof and the visibility of sheets, between the tray 261 for reusable sheets of paper and the tray 263 for non-reusable sheets of paper also in the erasing device 2 having such a limitation, an inclination angle of the second sheet loading surface 264 with respect to a horizontal plane is set to be greater than an inclination angle of the first sheet loading surface 262 with respect to a horizontal plane.

The management device 3 will now be described.

The management device 3 receives image data for a sheet from the erasing device 2, analyzes the image data, and determines whether or not the image in the image data can be erased (performs an erasing capability determination). The management device 3 sends the result of the erasing capability determination to the controller 25 of the erasing device 2. Moreover, if an erasing capability determination result showing that erasing is possible is received by the controller 25, the management device 3 sends the sheet related to the determination result to the color erasing section 24 to perform an erasing process. After the erasing process is performed, the management device 3 receives image data read again at the reading section 23 from the erasing device 2 so as to determine whether or not the sheet is reusable on the basis of an extent of non-erased portions (perform a reusability determination). Specifically, the image data of a sheet after being subjected to an erasing process is read at the reading section 23, and the management device 3 determines that the sheet is reusable if an extent of non-erased portions on the read sheet corresponds to an amount smaller than or equal to a predetermined amount. If the extent of non-erased portions on the read sheet corresponds to an amount greater than the predetermined amount, in contrast, the management device 3 determines that the sheet is not reusable. Note that a general-purpose PC may be employed as the management device 3.

Figure 2:
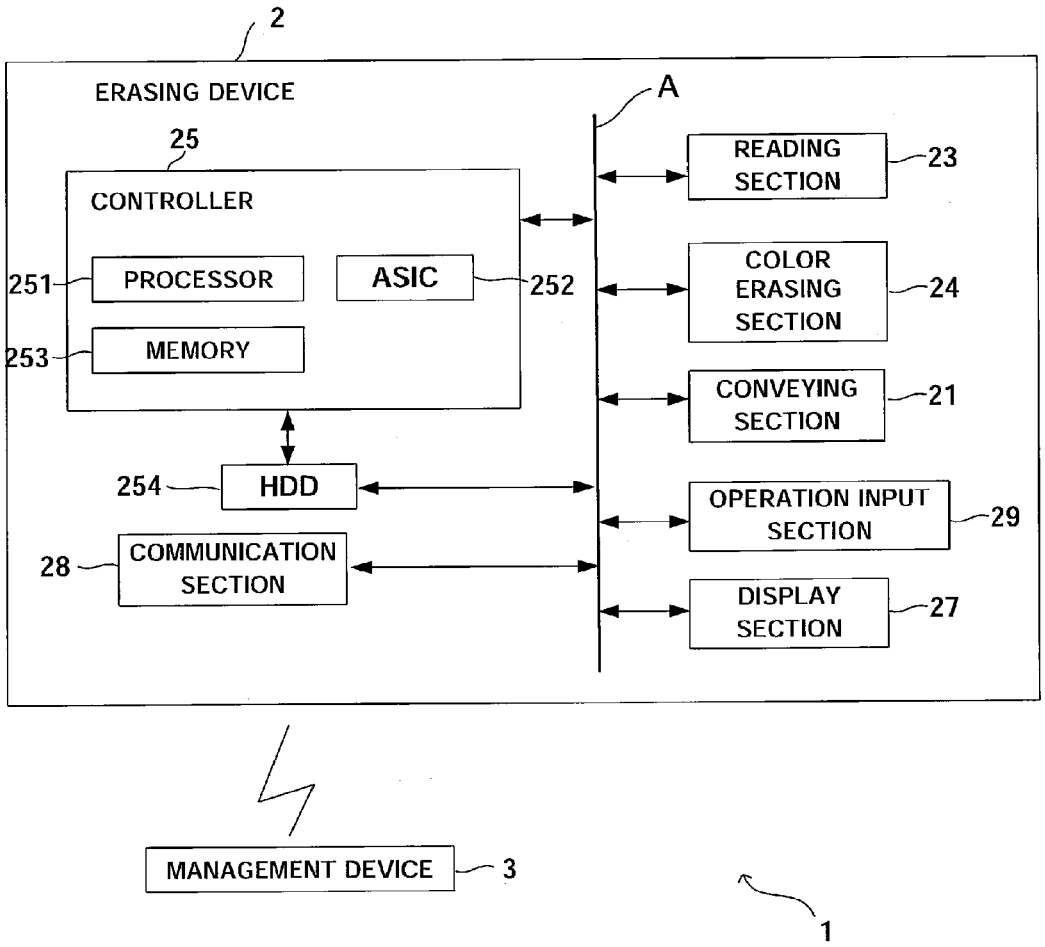
FIG. 2 is a hardware configuration diagram of the erasing system according to the first embodiment.

FIG. 2 is a block diagram showing a hardware configuration of the erasing device 2.

The erasing device 2 includes an operation input section 29, a display section 27, and a communication section 28 in addition to the reading section 23, the color erasing section 24, the conveying section 21, and the controller 25 described above. These components are connected with one another via a bus A.

The controller 25 includes a processor 251, an ASIC (Application Specific Integrated Circuit) 252, and the memory 253, and controls the entire erasing device 2. The controller 25 also receives the erasing capability determination result and the reusability determination result determined at the management device 3, and operates the flapper 22 and the conveying rollers 216 so as to send a sheet on the first conveying path 211 to the second branch point downstream side 211*a* of the first conveying path 211 or the second conveying path 212.

The operation input section 29 includes the touch-panel type display section 27 and operation keys such as a numeric keypad, a stop key, and a start key. A user gives instructions for the functional operations of the erasing device 2, such as the start of erasing or the reading of an image on a sheet to be erased, via the operation input section 29.

The display section 27 displays the setting information and an operation status of the erasing device 2, a log information, a notification to a user, and the like.

Note that the operation input section 29 is not limited to that disposed in the main body of the erasing device 2. For example, it may be configured so that an operation can be made from an operation section provided in an external device connected to the erasing device 2 via a network. Alternatively, it may be configured so that the operation input section 29 is provided independently from the main body of the erasing device 2 and operates the erasing device 2 by means of a wired or wireless communication. The operation input section 29 of the present embodiment is not limited to any particular operation input section as long as it can issue a processing instruction to the erasing device 2 or can enable the browsing of information, for example.

The communication section 28 is an interface to establish a connection with an external device. The communication section 28 communicates with an external device on a network via an appropriate wireless or wired connection such as IEEE 802.15, IEEE802.11, IEEE802.3, or IEEE3304 for the Bluetooth (registered trademark), an infrared connection, an optical link, or the like. The communication section 28 may further include a USB connection unit to which a connection terminal of the USB standard is connected, a parallel interface, or the like. The controller 25 communicates with the management device 3, a multifunction printer, and other external devices via the communication section 28. For example, although it has been described that an image read by the reading section 23 is stored in the memory section such as the memory 253 or the HDD 254 in the erasing device 2, embodiments are not limited thereto. For example, a communication with a user terminal (personal computer) or a multifunction printer, or a server, which are external devices, may be established via the communication section 28, and the image may be stored in a memory section in these external devices. The image data stored in such an external device may be readout from an operation section in the multifunction printer or the user terminal. Moreover, if the erasing device 2 has login and logout functions for the purpose of the personal authentication of a user, the image data stored in the memory section such as the memory 253 or the HDD 254 in the erasing device 2 may be sent to the external device at the time of logout from the erasing device 2 and may be stored therein.

Figure 3:
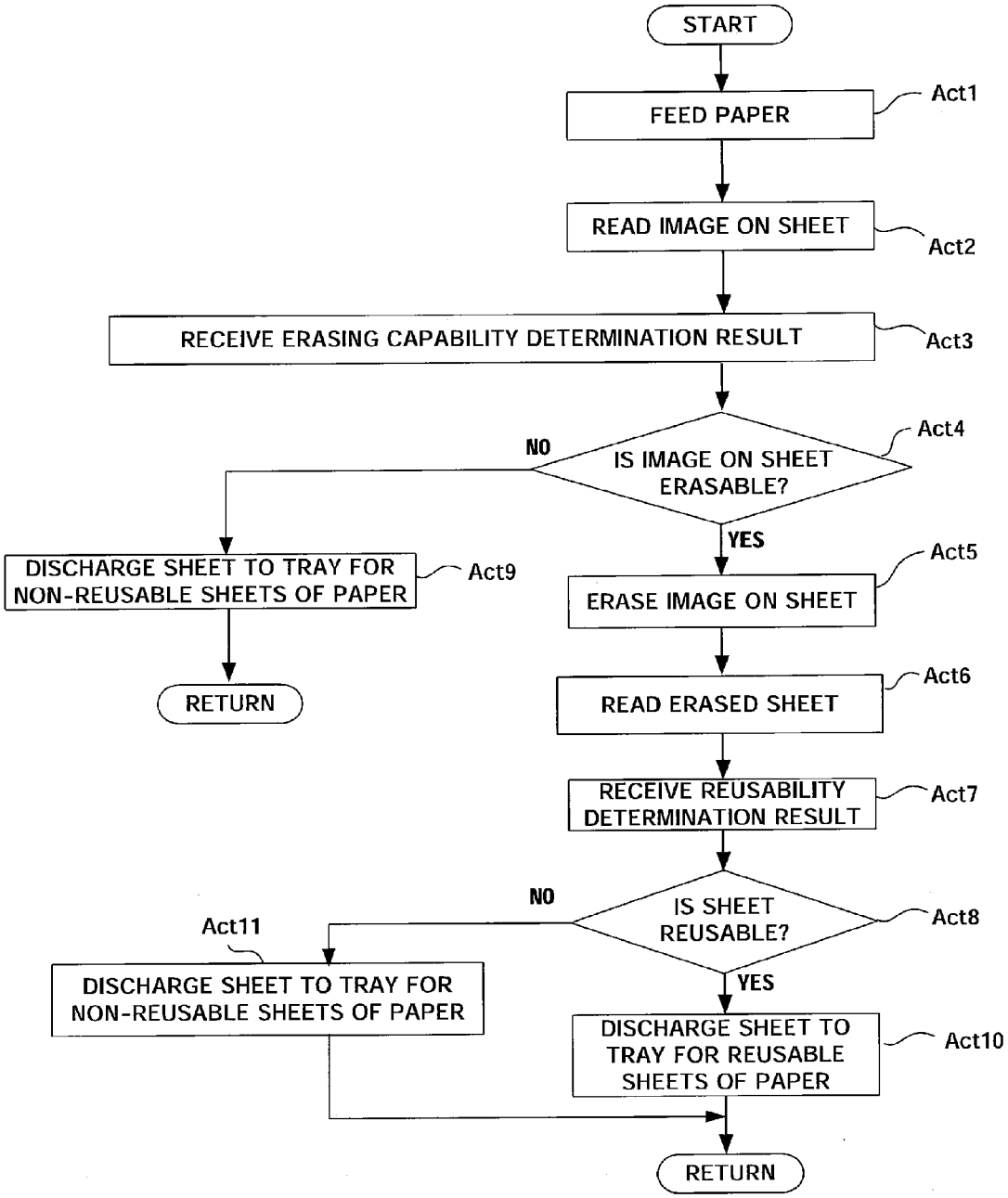
FIG. 3 is a flow chart showing an example of control for the erasing system according to the first embodiment.

An erasing process performed by the erasing device 2 will now be described with reference to the flow chart of FIG. 3. The erasing device 2 performs the erasing process when a program non-temporarily stored in the memory 253 is read by the processor 251.

The controller 25 first operates the pickup roller 215 so as to pick up a sheet having an image formed thereon with a color erasable material and loaded on the sheet feeding cassette 20 and to feed the sheet onto the first conveying path 211 (Act1).

The controller 25 reads the image on the sheet at the reading section 23, and sends the image data to the management device 3 via the communication section 28 (Act2). The controller 25 keeps the sheet waited between the reading section 23 and the color erasing section 24 on the loop-shaped conveying path 213. The management device 3 determines whether or not the image in the image data sent from the erasing device 2 can be erased, and sends the obtained erasing capability determination result to the erasing device 2.

The controller 25 receives the erasing capability determination result from the management device 3 (Act3).

If the controller 25 receives the erasing capability determination result showing that the image can be erased (Act4: YES), the sheet kept waited between the reading section 23 and the color erasing section 24 is conveyed to the color erasing section 24, and the image on the sheet is erased at the color erasing section 24 (Act5).

In contrast, if the controller 25 receives the erasing capability determination result showing that the image cannot be erased (in a case of a second determination result different from a first determination result to be described later) (Act4: NO), the sheet kept waited between the reading section 23 and the color erasing section 24 is conveyed to the second branch point downstream side 211*a* of the first conveying path 211, and the controller 25 then sends an output signal to the actuator 222 so as to operate the flapper 22 to be at a position to guide the sheet to the second conveying path 212. Then, the controller 25 operates the conveying rollers 216 to be rotated inversely so as to convey the sheet on the first conveying path 211 to the second conveying path 212 and then discharge the sheet to the tray 263 for non-reusable sheets of paper (Act9).

The controller 25 reads the surface of the sheet after being subjected to the erasing process at the reading section 23, and sends the image data to the management device 3 (Act6). The management device 3 determines whether or not the sheet after being subjected to the erasing process is reusable, and sends the obtained reusability determination result to the controller 25 (Act7).

If the controller 25 receives a reusability determination result showing that the sheet is reusable (in a case of the first determination result corresponding to the erasing capability determination result showing that the image can be erased and the reusability determination result showing that the sheet is reusable) (Act8: YES), the controller 25 sends an output signal to the actuator 222 so as to operate the flapper 22 to be at a position to guide the sheet to the second branch point downstream side 211*a* of the first conveying path 211. Then, the controller 25 drives the conveying rollers 216 so as to convey the sheet on the first conveying path 211 to the second branch point downstream side 211*a* and then discharge the sheet to the tray 261 for reusable sheets of paper (Act10).

If the controller 25 receives a reusability determination result showing that the sheet is not reusable (in a case of the second determination result different from the first determination result) (Act8: NO), the controller 25 drives the conveying rollers 216 so as to convey the sheet on the first conveying path 211 to the second branch point downstream side 211*a* and then sends an output signal to the actuator 222 so as to operate the flapper 22 to be at the position to guide the sheet to the second conveying path 212. Then, the controller 25 operates the conveying rollers 216 to be rotated inversely so as to convey the sheet on the first conveying path 211 to the second conveying path 212 and then discharge the sheet to the tray 263 for non-reusable sheets of paper (Act11).

Although the erasing device 2 of the above-described embodiment is configured so that a sheet is heated as an erasing process so as to erase an image on the sheet, the configuration of the erasing device 2 is not particularly limited thereto. The erasing device 2 may be alternatively configured to irradiate, as an erasing process, a sheet with light such as near-infrared light so as to erase an image on the sheet. In this case, the image on the sheet is formed by a color erasable toner or a color erasable ink which is erased by the irradiation of light such as near-infrared light. The color erasable toner or the color erasable ink which is erased by the irradiation of light may be a toner or an ink which is erased by light in the vicinity of 820 nm wavelength, for example, but does not respond to light in the vicinity of 600 nm wavelength irradiated from a fluorescent lamp.

Although it has been described that the management device 3 performs the erasing capability determination in the embodiment described above, embodiments are not particularly limited thereto. It may be configured so that the erasing capability determination is performed at the controller 25 in the erasing device 2.

Second Embodiment

Figure 4:
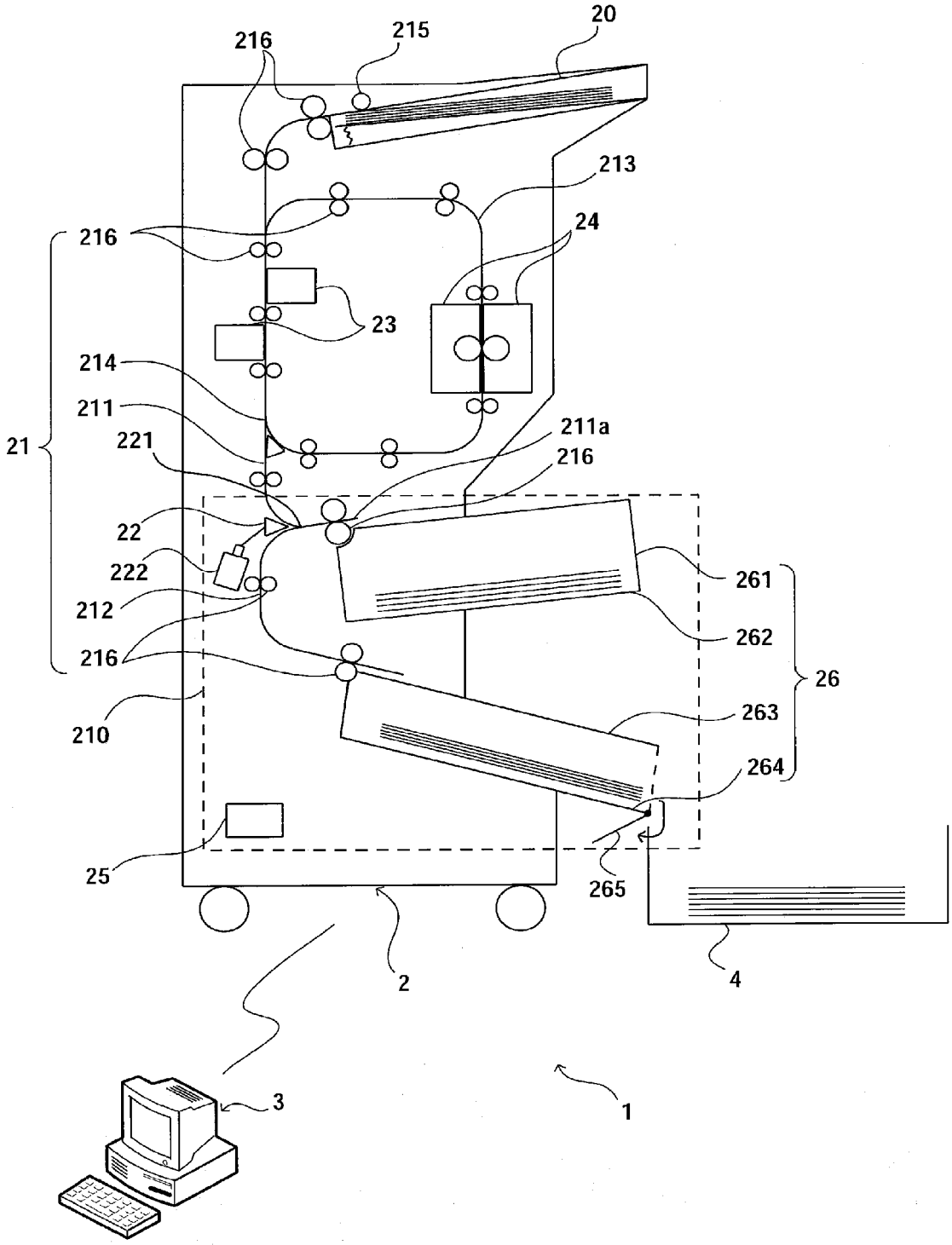
FIG. 4 is a schematic configuration diagram showing an erasing system according to a second embodiment.

In the second embodiment, it may be configured so that an abutting plate 265 provided at a downstream end in the sheet discharging direction of the tray 263 for non-reusable sheets of paper, which is the lower side of the discharge trays 26, is pivoted as shown in FIG. 4. The other configuration and control are the same as those in the first embodiment, and the descriptions thereof will be therefore omitted. In this second embodiment, the second sheet loading surface 264 of the tray 263 for non-reusable sheets of paper is configured so that the downstream end thereof in the sheet discharging direction is formed at a position lower than the upstream end thereof in the sheet discharging direction.

As shown in FIG. 4, the abutting plate 265 is configured so as to be pivotable between an abutting position at which the abutting plate 265 abuts against the downstream ends of sheets discharged onto the second sheet loading surface 264 in the sheet discharging direction and a retracted position at which the abutting plate 265 is retracted from the downstream ends of the sheets discharged onto the second sheet loading surface 264 in the sheet discharging direction. Such a configuration allows the downstream ends of the sheets to be aligned by the abutting of the abutting plate 265 if sheets are discharged to the tray 263 for non-reusable sheets of paper when the abutting plate 265 is at the abutting position. Moreover, by setting the abutting plate 265 at the retracted position, the sheets discharged onto the tray 263 for non-reusable sheets of paper can be slid along the inclination of the second sheet loading surface 264 toward the outside of the tray 263 for non-reusable sheets of paper. Thus, without being influenced by the sheet capacity of the tray 263 for non-reusable sheets of paper, sheet discharge to the tray 263 for non-reusable sheets of paper can be continued. Moreover, by placing a sheet collecting container 4 for accommodating sheets below the downstream end of the tray 263 for non-reusable sheets of paper in the sheet discharging direction as shown in FIG. 4, sheets determined to be non-reusable by the management device 3 can be discharged into the tray 263 for non-reusable sheets of paper regardless of the storage amount in the tray 263 for non-reusable sheets of paper.

Third Embodiment

In addition to the configuration of the erasing device 2 in the first embodiment, an erasing device 2*a* of the third embodiment has a discharge tray distance adjustment mechanism 5 pivotally supporting the tray 261 for reusable sheets of paper, which is the upper side of the discharge trays 26, with respect to the erasing device 2*a*. Since the other configuration and control are the same as those in the first embodiment, the descriptions thereof will be omitted.

Figure 5:
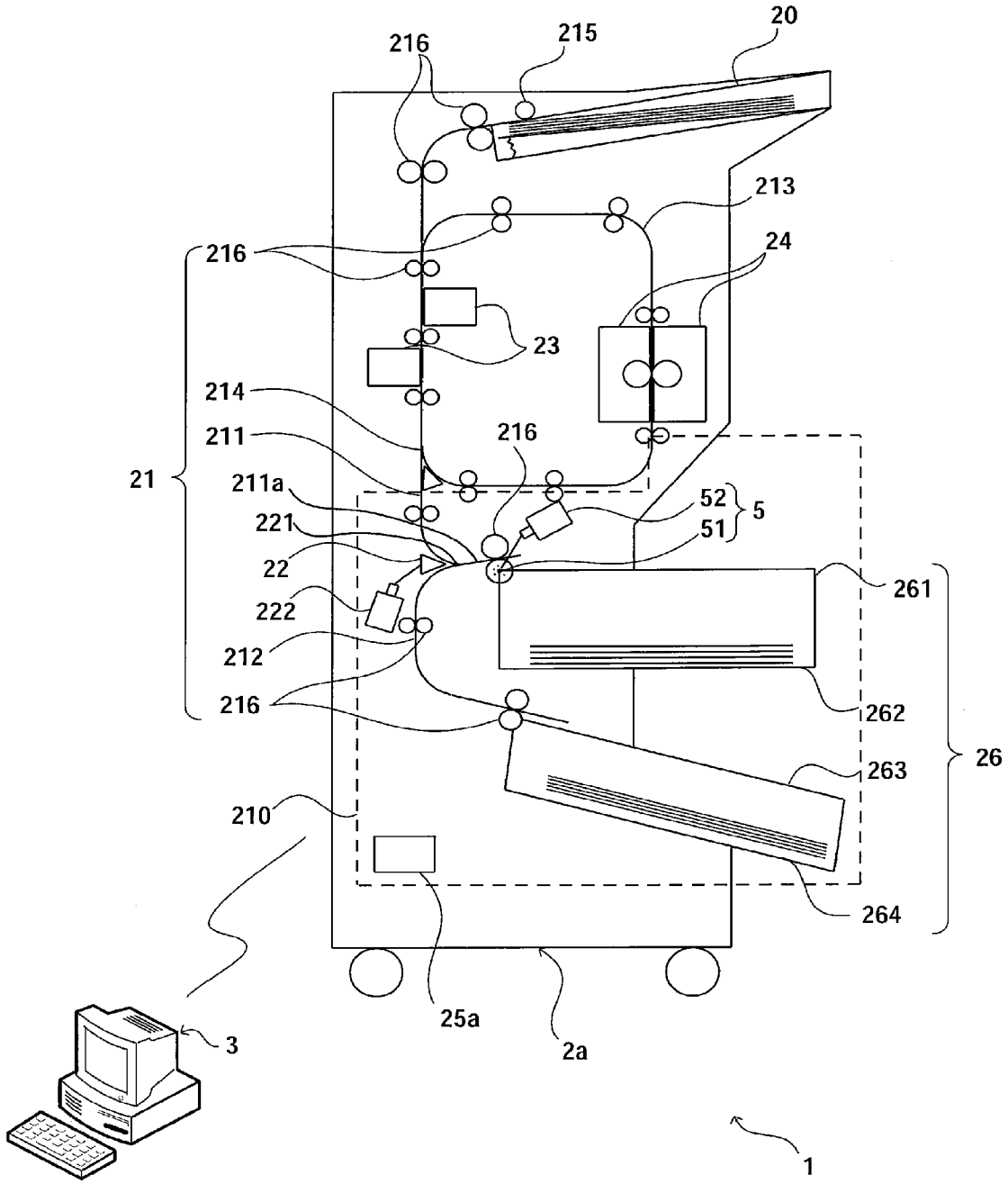
FIG. 5 is a schematic configuration diagram showing an erasing system according to a third embodiment before an operation thereof.
Figure 6:
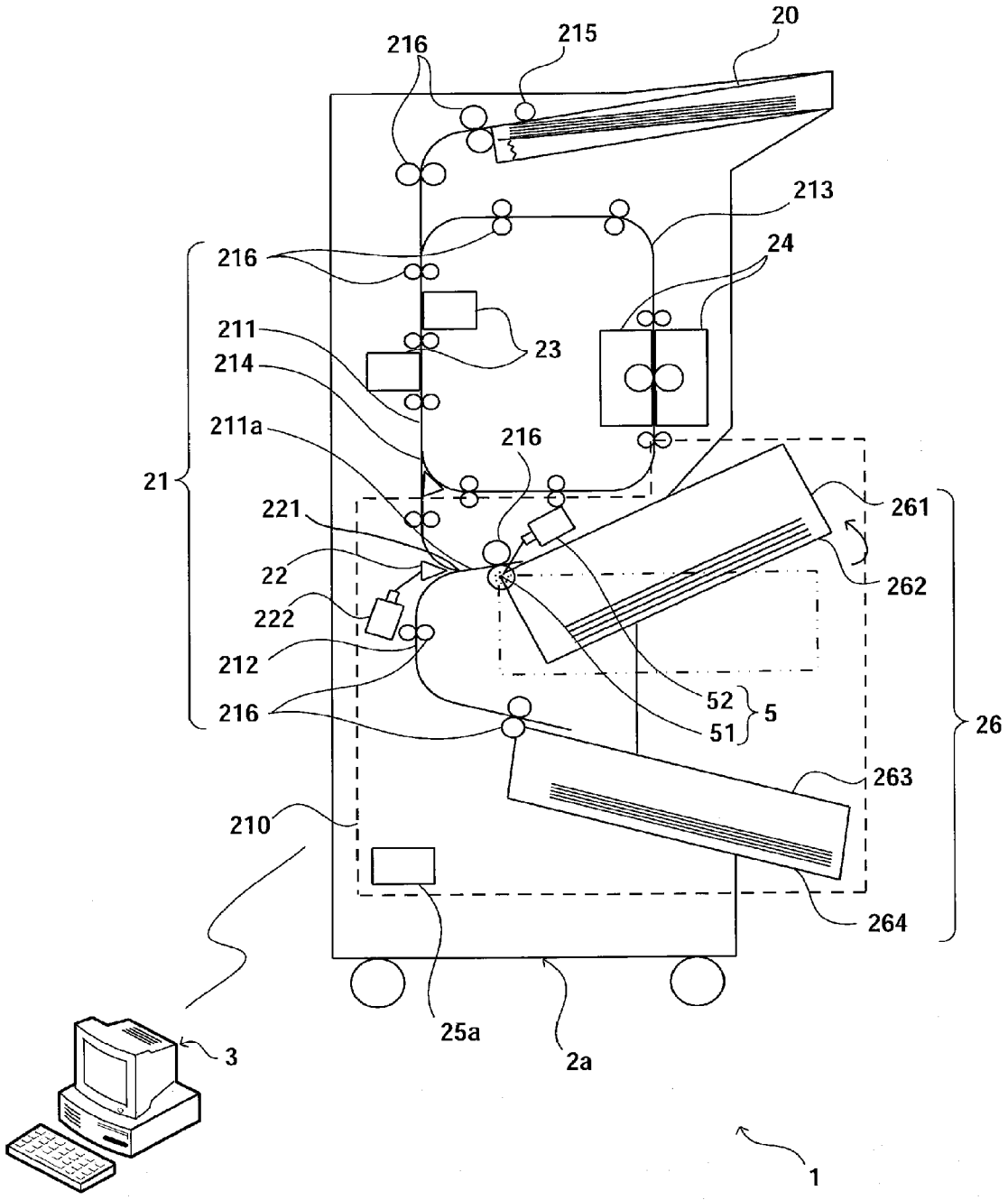
FIG. 6 is a schematic configuration diagram showing the erasing system according to the third embodiment after the operation thereof.

FIG. 5 is a schematic configuration diagram showing a state before the tray 261 for reusable sheets of paper in the present embodiment is moved upwardly. FIG. 6 is a schematic configuration diagram showing a state after the tray 261 for reusable sheets of paper in the present embodiment is moved upwardly.

Specifically, as shown in FIGS. 5 and 6, the discharge tray distance adjustment mechanism 5 is provided at the tray 261 for reusable sheets of paper, and drives the tray 261 for reusable sheets of paper so as to change between a first distance, which is the distance of the tray 263 for non-reusable sheets of paper from the tray 261 for reusable sheets of paper during a sheet discharging operation, and a second distance which is greater than the first distance. In other words, when a user takes out the sheets accommodated in the tray 261 for reusable sheets of paper and the tray 263 for non-reusable sheets of paper, the discharge tray distance adjustment mechanism 5 moves the tray 261 for reusable sheets of paper upwardly with respect to the tray 263 for non-reusable sheets of paper so as to make the second distance of the tray 263 for non-reusable sheets of paper from the tray 261 for reusable sheets of paper greater than the first distance of the tray 263 for non-reusable sheets of paper from the tray 261 for reusable sheets of paper corresponding to a case where a sheet is discharged into the tray 261 for reusable sheets of paper from the first conveying path 211 and a case where a sheet is discharged into the tray 263 for non-reusable sheets of paper from the second conveying path 212.

Due to such a configuration, when a user takes out the sheets discharged to the tray 263 for non-reusable sheets of paper, a distance between the downstream end of the tray 261 for reusable sheets of paper in the sheet discharging direction and the downstream end of the tray 263 for non-reusable sheets of paper in the sheet discharging direction can be increased from that during the sheet discharge operation in the erasing device 2*a*. Also when a user takes out the sheets discharged to the tray 263 for non-reusable sheets of paper, the tray 261 for reusable sheets of paper is less likely to be an obstacle, thereby contributing to an improvement in the operability thereof.

As shown in FIGS. 5 and 6, the discharge tray distance adjustment mechanism 5 is provided at the upstream end of the tray 261 for reusable sheets of paper in the sheet discharging direction, and includes a rotating shaft 51 pivotally fixing the tray 261 for reusable sheets of paper, and a pivot actuator 52 for allowing the tray 261 for reusable sheets of paper to be pivoted via a gear train mechanism (not shown) with the rotating shaft 51 being a pivot point. Due to this configuration, at a timing when a determination to take out sheets in the tray 263 for non-reusable sheets of paper is made by a controller 25*a*, the controller 25*a* sends an output signal to the pivot actuator 52 so as to make the tray 261 for reusable sheets of paper pivot with the rotating shaft 51 being a pivot point via the gear train mechanism and move upwardly. Examples of the timing when a determination to take out the sheets is made by the controller 25*a* include a case when a user pushes a sheet removal button or the like at the operation input section 29.

Here, although the discharge tray distance adjustment mechanism 5 has been described as being composed of the pivot actuator 52 and the rotating shaft 51, the discharge tray distance adjustment mechanism 5 is not particularly limited thereto. It may be configured to have the rotating shaft 51 only. Also with such a configuration, a user can take out sheets in the lower side tray 263 for non-reusable sheets of paper by lifting up the tray 261 for reusable sheets of paper at a desired timing. Moreover, since this configuration eliminates the need to provide the pivot actuator 52, the device configuration thereof can be simplified and the manufacturing cost thereof can be therefore reduced.

Although the third embodiment has been described to have the configuration including the discharge tray distance adjustment mechanism 5 in the tray 261 for reusable sheets of paper positioned at the upper side of the discharge trays 26, the configuration of the discharge tray distance adjustment mechanism 5 is not particularly limited thereto. It may be provided in the tray 263 for non-reusable sheets of paper. Such a configuration makes it possible to move the tray 263 for non-reusable sheets of paper downwardly with respect to the erasing device 2*a*, thereby obtaining a large distance between the tray 261 for reusable sheets of paper and the tray 263 for non-reusable sheets of paper. The discharge tray distance adjustment mechanism 5 may be provided at least in one of the tray for reusable sheets of paper and the tray for non-reusable sheets of paper so that the distance between the tray 261 for reusable sheets of paper and the tray 263 for non-reusable sheets of paper can be increased consequently.

Moreover, although it has been described that the upper side of the discharge trays 26 is the tray 261 for reusable sheets of paper and the lower side of the discharge trays 26 is the tray 263 for non-reusable sheets of paper in the first to third embodiments described above, embodiments are not particularly limited thereto. The upper side of the discharge trays 26 may be the tray 263 for non-reusable sheets of paper, and the lower side of the discharge trays 26 may be the tray 261 for reusable sheets of paper.

In the first to third embodiments described above, there have been described the examples in which embodiments are applied to the erasing system 1. However, embodiments are not particularly limited thereto. It may be simply the sheet discharging device 210 for sorting sheets into the tray 261 for reusable sheets of paper and the tray 263 for non-reusable sheets of paper. The sheet discharging device 210 is configured to include the conveying section 21, the flapper 22, the controller 25 or 25*a*, the tray 261 for reusable sheets of paper, and the tray 263 for non-reusable sheets of paper described above (a portion surrounded by a broken line in FIG. 1, 5, 6, or 7). The sheet discharging device 210 may be any device as long as it has a plurality of discharge trays 26, and may also be applied to a fax machine, an image forming apparatus, or the like, in addition to the erasing device 2 or 2*a*.

Fourth Embodiment

In the fourth embodiment, the discharge tray 26 in the first to third embodiments has the following configuration. Since the other configuration and control are the same as those in the first to third embodiments, the descriptions thereof will be omitted.

Figure 7:
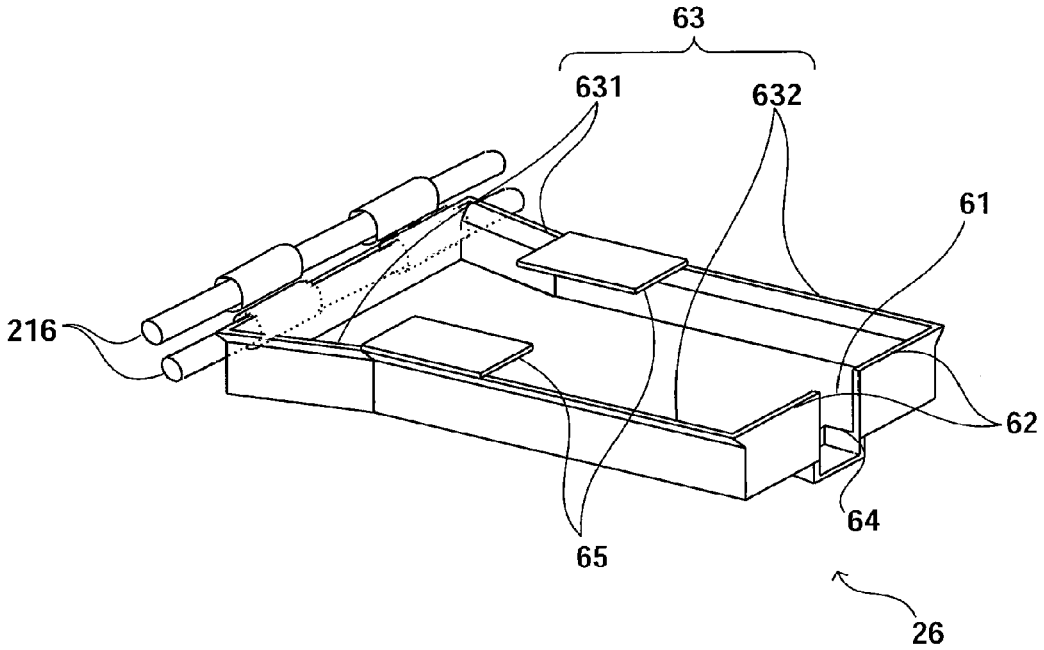
FIG. 7 is a perspective view of an upper surface of a discharge tray according to a fourth embodiment.
Figure 8:
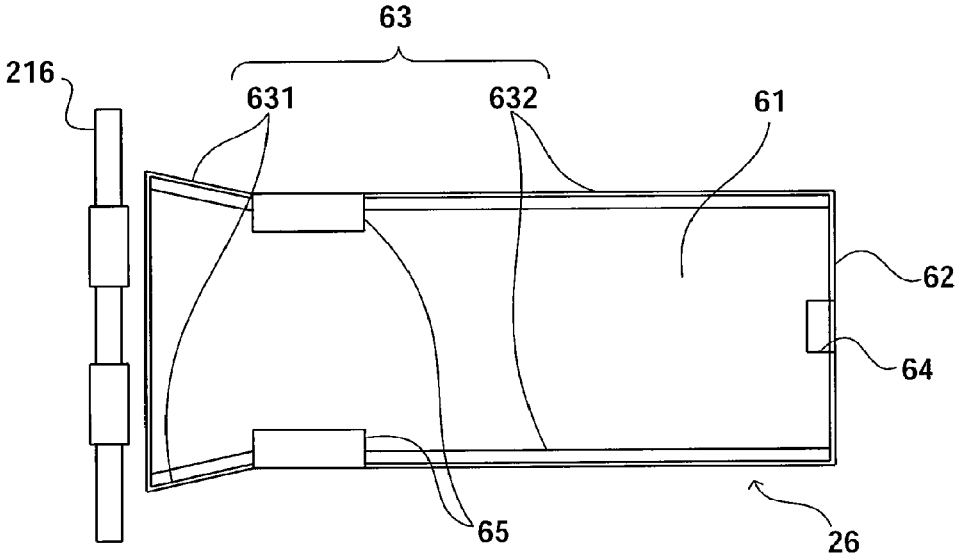
FIG. 8 is a top view of the discharge tray according to the fourth embodiment.

FIG. 7 is a perspective view showing an upper side of the discharge tray 26 in the fourth embodiment. FIG. 8 is a top view of the discharge tray 26 in the fourth embodiment, and FIG. 9 is an elevation view of the discharge tray 26 in the fourth embodiment.

Figure 9:
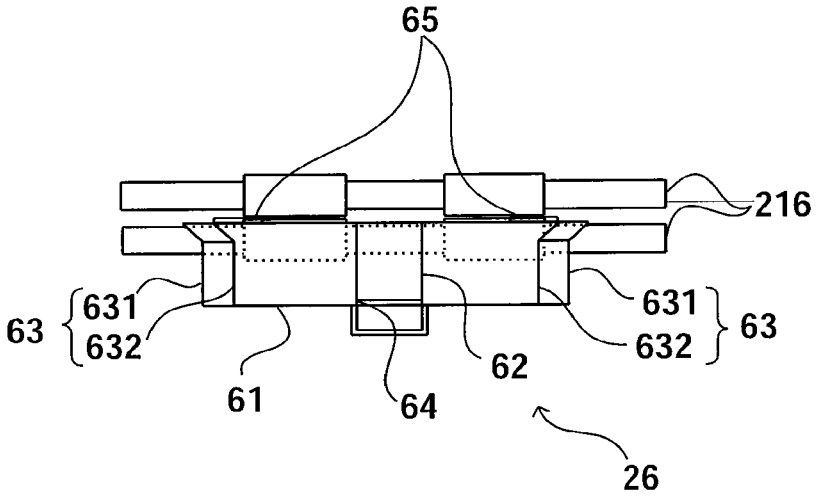
FIG. 9 is an elevation view of the discharge tray according to the fourth embodiment.

As shown in FIGS. 7 to 9, the discharge tray 26 of the present embodiment is in the form of a container. The discharge tray 26 is formed by a loading surface 61 on which sheets are loaded, an abutment wall 62 which is a wall surface of the discharge tray 26 on the downstream side in the sheet discharging direction and abuts against an end of a sheet discharged from the conveying path, and lateral alignment walls 63 for aligning ends of a sheet in a direction perpendicular to the sheet discharging direction.

The lateral alignment walls 63 form both the side wall surfaces of the discharge tray 26, and include tapered portions 631 positioned on the upstream side in the sheet discharging direction and slanted so as to be narrowed inwardly toward the downstream side in the sheet discharging direction, and parallel portions 632 extending parallel to the sheet discharging direction from the downstream ends of the tapered portions 631 in the sheet discharging direction to the abutment wall 62. The maximum width between the tapered portions 631 may be preferably set to be greater than the width between the parallel portions 632 by 10 mm or more.

Such a configuration allows sheets to be loaded in an aligned manner by utilizing the force of a sheet being discharged from the conveying path without providing, in the discharge tray 26, alignment means for aligning sheets loaded in the discharge tray 26. Moreover, the tapered portions 631 provided in portions upstream of the lateral alignment walls 63 allow sheets discharged from the conveying path to be easily loaded in the discharge tray 26.

The length of the tapered portion 631 in the sheet discharging direction may be preferably set to be smaller than the length of a sheet to be conveyed along the conveying path in the sheet conveying direction. Due to such a configuration, when the front edge of a sheet discharged from the conveying path reaches at least a part of the parallel portions 632, the position of the sheet to be accommodated in the discharge tray 26 can be aligned along the lateral direction with those of other sheets in the discharge tray 26.

Moreover, the length of the lateral alignment wall 63 in the sheet discharging direction may be preferably set to be greater than the length of a sheet to be accommodated in the discharge tray 26 in the sheet discharging direction. Such a configuration makes it possible to prevent the front edge of a sheet discharged from the conveying path from striking the abutment wall 62 with a part of the sheet being positioned on the conveying path. It is further possible to prevent a sheet discharged into the discharge tray 26 from being bounced by the abutment wall 62 so that the sheet fails to be loaded in the discharge tray 26.

As shown in FIGS. 7 and 9, the lateral alignment walls 63 of the discharge tray 26 may be configured to be composed of parallel width portions such that distances between the opposing wall surfaces in the width direction are parallel to one another and increased width portions such that a distance between the opposing wall surfaces in the width direction is increased toward the upstream direction thereof. Such a configuration makes it possible to facilitate the discharge of a sheet discharged from the conveying path into the discharge tray 26 and to gradually align the sheet discharged into the discharge tray 26 with the loading surface 61.

As shown in FIGS. 7 and 8, an opening 64 may be provided on the loading surface 61 of the discharge tray 26 on the abutment wall 62 side. With such a configuration, a user can insert a hand into the opening 64 so as to grasp the lower surface and the upper surface of the sheets loaded in the discharge tray 26. As a result, the user can take out the sheets from the discharge tray 26 smoothly.

Moreover, as shown in FIGS. 7 to 9, discharged sheet hold-down plates 65 may be provided so as to each extend from a junction between the tapered portion 631 and the parallel portion 632 toward the parallel portion 632 side and so as to each extend toward the inner side of the discharge tray 26 from the upper edge of the parallel portion 632. If a large number of sheets are loaded in the discharge tray 26, such a configuration makes it possible to prevent sheets from overflowing to the outside of the discharge tray 26 since the upper surface of the sheets is held by the discharged sheet hold-down plates 65.

Figure 10:
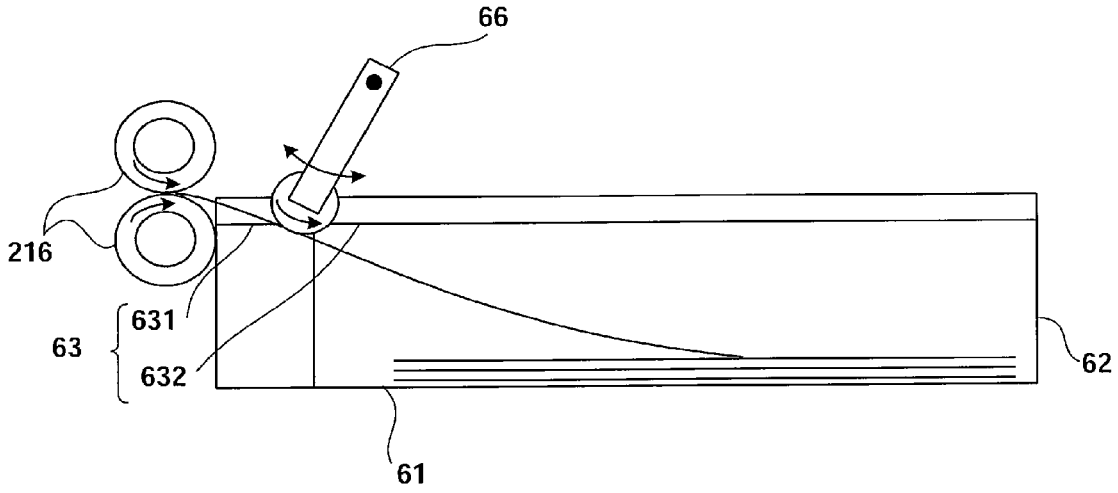
FIG. 10 is an operation explanatory drawing showing a modification of the discharge tray according to the fourth embodiment.

As further shown in FIG. 10, the discharge tray 26 may include an alignment roller 66 provided for aligning a sheet discharged from the conveying path so as to be loaded into the discharge tray 26 and positioned so as to abut against a sheet being discharged from the conveying path. Such a configuration makes it possible to prevent the sheet discharged from the conveying path from flying out from the discharge tray 26. Moreover, the sheet discharged from the conveying path can be smoothly loaded on the loading surface 61.

According to the fourth embodiment, it is further possible to provide discharge trays having configurations as follows, for example.

(1) The discharge tray having the configuration as described above, including:

a loading surface on which a sheet is loaded;

an abutment wall that is a wall surface of the discharge tray on a downstream side in a sheet discharging direction and abuts against an end of a sheet discharged from the conveying path; and lateral alignment walls forming both side wall surfaces of the discharge tray and configured to align ends of a sheet in a direction perpendicular to the sheet discharging direction, the lateral alignment walls including tapered portions positioned on an upstream side in the sheet discharging direction and slanted so as to be narrowed inwardly toward the downstream side in the sheet discharging direction and parallel portions extending parallel to the sheet discharging direction from the downstream ends of the tapered portions in the sheet discharging direction to the abutment wall.

(2) The discharge tray having the configuration as described above in which the length of the tapered portion in the sheet discharging direction is smaller than the length of a sheet to be conveyed on the conveying path in a sheet conveying direction.

(3) The discharge tray having the configuration as described above in which the length of the lateral alignment wall in the sheet discharging direction is greater than the length of a sheet to be accommodated in the discharge tray in the sheet discharging direction.

(4) The discharge tray having the configuration as described above in which the lateral alignment walls are formed by parallel width portions such that distances between opposing wall surfaces in a width direction are parallel to one another and increased width portions such that a distance between the opposing wall surfaces in the width direction is increased toward an upstream direction.

(5) The discharge tray having the configuration as described above, further including an alignment roller configured to align a sheet discharged from the conveying path so as to be accommodated into the discharge tray and positioned so as to abut against a sheet being discharged from the conveying path.

As described above in detail, according to the technique described in this specification, it is possible to provide the technique for improving the convenience for a user when taking out sheets outputted to a plurality of discharge trays.

While certain embodiments have been described, these embodiments have been presented by way of example only, and are not intended to limit the scope of invention. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet discharging device comprising:

a first conveying path configured to guide a sheet to be conveyed;

a second conveying path branched from the first conveying path at a branch point of the first conveying path;

a sorting section configured to sort a sheet being conveyed on the first conveying path into either a downstream side of the branch point on the first conveying path or the second conveying path;

a first discharge tray placed at a position downstream of the first conveying path in a sheet conveying direction thereof and configured to receive a sheet discharged from the first conveying path at a first sheet loading surface;

a second discharge tray placed at a position downstream of the second conveying path in a sheet conveying direction thereof and configured to receive a sheet discharged from the second conveying path at a second sheet loading surface; and a discharge tray distance adjustment mechanism configured to control at least one of the first discharge tray and the second discharge tray so that a distance between a downstream end in a sheet discharging direction in one of the first discharge tray and the second discharge tray and a downstream end in a sheet discharging direction in the other one of the first discharge tray and the second discharge tray is displaced between a first distance during a sheet discharging operation to one of the first discharge tray and the second discharge tray and a second distance that is greater than the first distance.

2. The device according to claim 1, wherein the second discharge tray placed so that a distance to the first sheet loading surface increases toward a downstream side thereof in a sheet discharging direction.

3. The device according to claim 1, wherein the second discharge tray placed below the first discharge tray.

4. The device according to claim 1, wherein a downstream end of the second sheet loading surface in the sheet discharging direction with respect to the second sheet loading surface is configured so as to be projected more in a horizontal direction from the sheet discharging device than a downstream end of the first sheet loading surface in a sheet discharging direction with respect to the first sheet loading surface.

5. The device according to claim 1, wherein the second sheet loading surface is configured so that a downstream end thereof in the sheet discharging direction is positioned lower than an upstream end thereof in the sheet discharging direction.

6. The device according to claim 1, further comprising:

an image reading section provided on the first conveying path and configured to read an image on a sheet being conveyed on the first conveying path; and a sorting determination section configured to make a determination on which one of the first and second discharge trays the sheet is discharged into on the basis of the image read by the image reading section, and wherein the sorting section sorts the sheet being conveyed on the first conveying path into either the downstream side of the branch point on the first conveying path or the second conveying path on the basis of a determination result at the sorting determination section.

7. The device according to claim 1, wherein the second sheet loading surface is configured so that a downstream end thereof in the sheet discharging direction is positioned lower than an upstream end thereof in the sheet discharging direction, and an inclination angle of the second sheet loading surface with respect to a horizontal plane is greater than an inclination angle of the first sheet loading surface with respect to a horizontal plane.

8. The device according to claim 1, wherein the discharge tray distance adjustment mechanism include an actuator which drive the displacement between the first distance and the second distance.

9. An erasing device comprising:

a first conveying path configured to guide a sheet to be conveyed;

a second conveying path branched from the first conveying path at a branch point of the first conveying path;

a first discharge tray placed at a position downstream of the first conveying path in a sheet conveying direction thereof and configured to receive a sheet discharged from the first conveying path at a first sheet loading surface;

a second discharge tray placed at a position downstream of the second conveying path in a sheet conveying direction thereof and configured to receive a sheet discharged from the second conveying path at a second sheet loading surface;

an image reading section positioned above the branch point of the first conveying path and the second conveying path and configured to optically read an image outputted on a sheet;

an color erasing section placed at a position downstream of the image reading section in the sheet conveying direction and configured to perform an erasing process on a sheet;

a determination result receiving section configured to transmit a result obtained by reading an image on a sheet and an image on a sheet after being subjected to the erasing process by the image reading section and to receive an erasing capability determination result showing that the image printed on the sheet is an erasable image or showing that the image is a non-erasable image, and a reusability determination result showing that the sheet is reusable or showing that the sheet is non-reusable;

a sorting section configured to sort a sheet being conveyed on the first conveying path into either a downstream side of the branch point on the first conveying path or the second conveying path, the sorting section sorting the sheet on the first conveying path into the downstream side of the branch point on the first conveying path if a first determination result corresponding to the erasing capability determination result showing that the image is erasable and the reusability determination result showing that the sheet is reusable is received at the determination result receiving section, and sorting the sheet on the first conveying path into the second conveying path if a second determination result different from the first determination result is received at the determination result receiving section; and a discharge tray distance adjustment mechanism configured to drive at least one of the first discharge tray and the second discharge tray so that a distance between a downstream end in a sheet discharging direction in one of the first discharge tray and the second discharge tray and a downstream end in a sheet discharging direction in the other one of the first discharge tray and the second discharge tray is displaced between a first distance during a sheet discharging operation to one of the first discharge tray and the second discharge tray and a second distance that is greater than the first distance.

10. The device according to claim 9, wherein the second discharge tray placed so that a distance to the first sheet loading surface increases toward a downstream side thereof in a sheet discharging direction.

11. The device according to claim 9, wherein the second discharge tray placed below the first discharge tray.

12. The device according to claim 9, wherein a downstream end of the second sheet loading surface in the sheet discharging direction with respect to the second sheet loading surface is configured so as to be projected more in a horizontal direction from the sheet discharging device than a downstream end of the first sheet loading surface in a sheet discharging direction with respect to the first sheet loading surface.

13. The device according to claim 9, wherein the second sheet loading surface is configured so that a downstream end thereof in the sheet discharging direction is positioned lower than an upstream end thereof in the sheet discharging direction.

14. The device according to claim 9, wherein the second sheet loading surface is configured so that a downstream end thereof in the sheet discharging direction is positioned lower than an upstream end thereof in the sheet discharging direction, and an inclination angle of the second sheet loading surface with respect to a horizontal plane is greater than an inclination angle of the first sheet loading surface with respect to a horizontal plane.

15. The device according to claim 9, wherein the discharge tray distance adjustment mechanism include an actuator which drive the displacement between the first distance and the second distance.

* * * * *